US005103263A

United States Patent [19]

Moore et al.

[11] Patent Number: 5,103,263

[45] Date of Patent: Apr. 7, 1992

[54] POWDER TRANSPORT, FUSING AND IMAGING APPARATUS

[75] Inventors: Robert A. Moore, Waquoit; William R. Buchan, Pocasset, both of Mass.

[73] Assignee: Delphax Systems, Canton, Mass.

[21] Appl. No.: 692,358

[22] Filed: Apr. 26, 1991

Related U.S. Application Data

[63] Continuation-in-part of Ser. No. 355,994, May 28, 1989, Pat. No. 5,012,291.

[51] Int. Cl.[5] ..... G03G 19/00; G03G 15/00

[52] U.S. Cl. ..... 355/212; 355/271; 355/319; 101/DIG. 37; 346/160; 346/74.2; 430/66

[58] Field of Search ..... 355/271, 274, 275, 279, 355/282, 285, 286, 288, 289, 290, 319, 212; 101/DIG. 37; 346/153.1, 160, 74.2; 430/66, 67

[56] References Cited

U.S. PATENT DOCUMENTS

| | | | |
|---|---|---|---|
| 3,536,398 | 10/1970 | Bhagat | 355/319 X |
| 3,936,171 | 2/1976 | Brooke | 355/271 |
| 3,937,572 | 2/1976 | Gaynor et al. | 355/212 X |
| 3,940,210 | 2/1976 | Donohue | 355/319 X |
| 4,427,285 | 1/1984 | Stange | 355/288 |
| 4,869,982 | 9/1989 | Murphy | 430/66 X |

*Primary Examiner*—R. L. Moses
*Attorney, Agent, or Firm*—Lahive & Cockfield

[57] ABSTRACT

A photoconductive or magnetic filler allows a single thin belt to serve as the imaging element, i.e., as the latent and developed image carrier, as well as the element which transfers and fuses toner to a print. The transport member moves in a cyclic path to carry material from a first location to a second location maintained at a higher temperature, and counter-moving portions of the member are positioned to exchange heat with each other along an intermediate portion of the path, so that minimum energy is lost to the environment. In one embodiment as a printing apparatus, a belt transports a heat-fusible toner to a heated location where it is transferred and fused, i.e., transfused, as a print image to a sheet. Effective powder pick up and release is obtained in the printing apparatus with a transport member having an elastomeric layer of a softness which conforms to a receiving member of characteristic surface roughness, and a non-tacky outer coating which is harder than the elastomeric layer. The outer coating is thin enough to conform to the surface roughness, but hard enough to prevent entrainment of toner particles. A duplex system employs two belt-imaging members which each travel over one of a pair of opposed pressure rollers having identical elastic characteristics.

27 Claims, 7 Drawing Sheets

POWDER TRANSPORT, FUSING AND IMAGING APPARATUS

This application is a continuation-in-part of U.S. patent application Ser. No. 355,994 filed May 28, 1989, issuing on Apr. 30, 1991 as U.S. Pat. No. 5,012,291. The full text of that document is incorporated herein by reference for purposes of detailed disclosure of the range of apparatus to which the present invention pertains and in which an exclusive right is claimed.

BACKGROUND

The present invention relates to improvements in mass transport systems, and to such systems wherein a discrete quantity of material is moved from a first location maintained at a first temperature, to a second location maintained at a different temperature. It relates in particular to systems such as a printing system wherein an image- or color-forming material of slight mass is carried to a second location of higher temperature where it is fused to a receiving medium.

In the field of photocopying or printing, it is known to print by first forming an electrostatic latent image on a photoconductive drum or belt, developing the electrostatic latent image on the drum with a toner, and then transferring the toner to a moving belt which carries the toner past a heat fusing station where the toner is melted and transferred to paper or some other print medium. Systems of this type are shown in U.S. Pat. Nos. 3,893,761; 3,923,392; and 3,947,113. Such a system has been made and marketed commercially.

In the commercial system known to applicant, the primary function of the belt is to provide a transport mechanism to carry the developed toner image to a high temperature fusing and transfer station. The belt is a relatively thick belt, e.g., one or more millimeters thick, that is operated isothermally at a temperature over 100° Celsius which is sufficient to fuse the transported toner. In such a construction, the belt serves to isolate the primary latent-image forming member, which is a photoconductive belt, from the high fusing temperatures; this allows the photoconductive belt to operate with a conventional powdered toner image development technology.

Such construction results in a complex assembly wherein a first image forming and toner transport mechanism is operated at one temperature, and a comparably large transport assembly is maintained at a higher temperature within the machine. The machine requires a significant power input for its heated portion, and is mechanically complex. The transfer of toner between two or more intermediate members adds considerations of image quality.

Accordingly, it would be desirable in systems of this sort to simplify the mechanical structure, reduce the power requirements, and improve the image transfer characteristics.

SUMMARY AND OBJECTS OF THE INVENTION

It is an object of the invention to provide a thermally efficient transport between two locations at different temperatures.

It is another object of the invention to provide a transport member having effective pick up and release properties.

It is another object of the invention to provide an efficient image forming apparatus wherein a latent image is developed with a toner powder at one location and the developed image is transferred and fused to a sheet to form a print at a second location.

It is another object of the invention to provide a simplified printer structure with electrical, optical, or magnetic image forming or erasing.

These and other desirable qualities are achieved in one aspect of the invention by a printing system wherein a transport member, illustratively an endless belt, moves between an unheated location where it picks up particles, and a heated location where the particles are melted and transferred to a sheet to form a print. The belt has a low thermal mass and portions of the belt moving in opposite directions between the heated and unheated locations are maintained in proximity so that they exchange heat. This reduces the energy required to bring each portion of the belt about each location into thermal equilibrium with that location, reducing the amount of energy lost due to thermal cycling of the belt. In another aspect of the invention, the transport member has a multi-layer structure with a sublayer and a surface layer. The sublayer is an elastomeric layer of a softness which yields at low pressure to effectively conform at a dimension characteristic of a print surface of a fibrous roughness, and the surface or outer layer which is formed of a material which is hard at spatial frequencies below that characteristic dimension.

In one system, a charge deposition print head structure deposits a charge distribution on the belt member to form an electrostatic latent image. In this embodiment, a dielectric filler material may be added to the material of at least one layer to achieve a belt capacitance of 50–250 pf/cm$^2$, and the outer coating layer enables a single imaging member to achieve both toner pick up and release for image formation and printing. A photoconductive filler material may also be added to permit erasure of residual or latent images by flood illumination.

In another system, a photoconductive filler material is added, and the latent charge image is formed by optical imaging techniques, or is erased by the application of light energy.

In yet another system, the latent image is a magnetic image formed by a magnetic recording assembly. In this embodiment, a magnetizable filler material is added to the belt surface layer.

DETAILED DESCRIPTION

Figure 1:
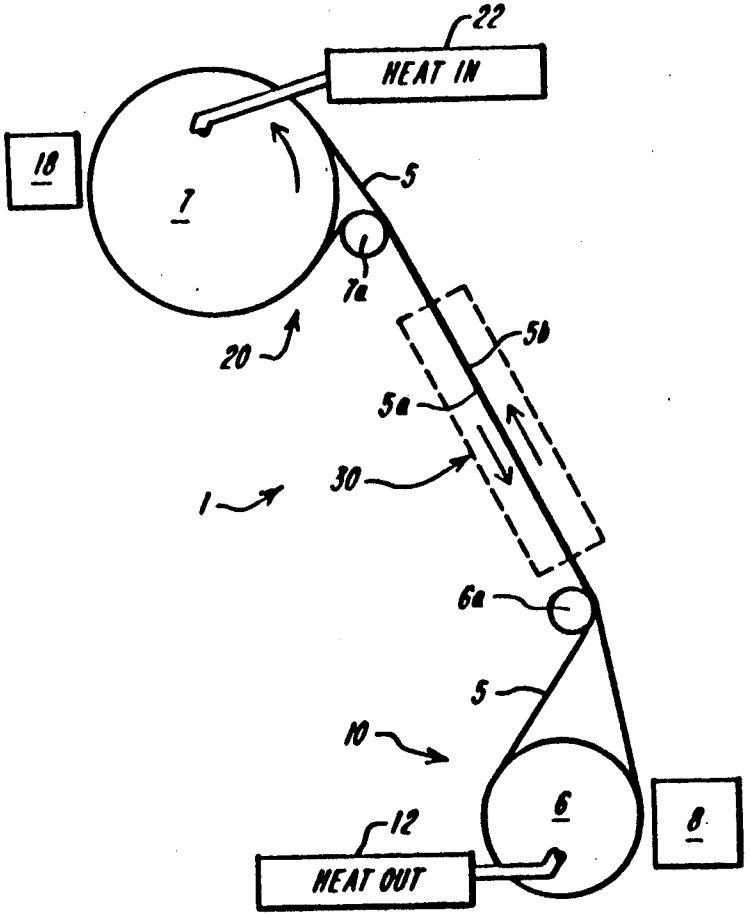
FIG. 1 shows a schematic view of a thermal transport system according to the present invention.

FIG. 1 illustrates in schema a principal aspect of the present invention, wherein an apparatus 1 moves a discrete mass of material between a first location 10 maintained at a first temperature, and a second location 20 maintained at a different temperature, through an intermediate region 30.

In the illustrated embodiment, location 10 is a "cold" location, with its temperature range maintained in a preset operating range by a cooler or ventilator 12, and location 20 is a "hot" location, maintained at a higher temperature by a heater 22. Cooler 12 and heater 22 may be omitted in applications where process conditions at the respective locations, such as a continuous influx of cool or hot material, provide the appropriate heat level. Further, the relative positions of the hot and cold locations may be interchanged, so long as there are two process locations maintained at differing temperatures.

A belt member 5 suspended over rollers 6, 7 at locations 10, 20 respectively, moves in a cyclic manner between the two locations, carrying material which is deposited on the belt 5 by a material deposition unit 8 at one location. The material is received by a material receiving unit 18 at the other location, having undergone a temperature change corresponding to the difference between the depositing and receiving environments.

According to a principal aspect of the invention, a thermal shunt is provided between counter-moving hot and cold portions of the belt to diminish the amount of heat transported from the hot region of the apparatus. This is achieved by having appositely moving portions of the belt 5*a*, 5*b* maintained in close proximity, and preferably contacting each other, in a region 30 between locations 10 and 20, so that they exchange heat. A pair of path-defining idler rollers or shoes 6*a*, 7*a* maintain the desired belt path. As illustrated, the cold-to-hot moving belt portion 5*b* which carries deposited material, receives heat from the hot-to-cold moving belt portion 5*a*. This counterflow heat exchange raises the temperature of portion 5*b* and the material it carries, while lowering the temperature of the empty return portion 5*a*. The heat capacity, thermal conductivity, belt thickness, length of heat exchanger and belt speed are selected to allow effective heat transfer between the counter-moving belt portions, so that only a small amount of heat is transported to location 10. This construction reduces the amount of energy lost by unwanted energy transport between the two locations, and reduces the amount of energy required to maintain the operating temperature of each of the locations.

Figure 2:
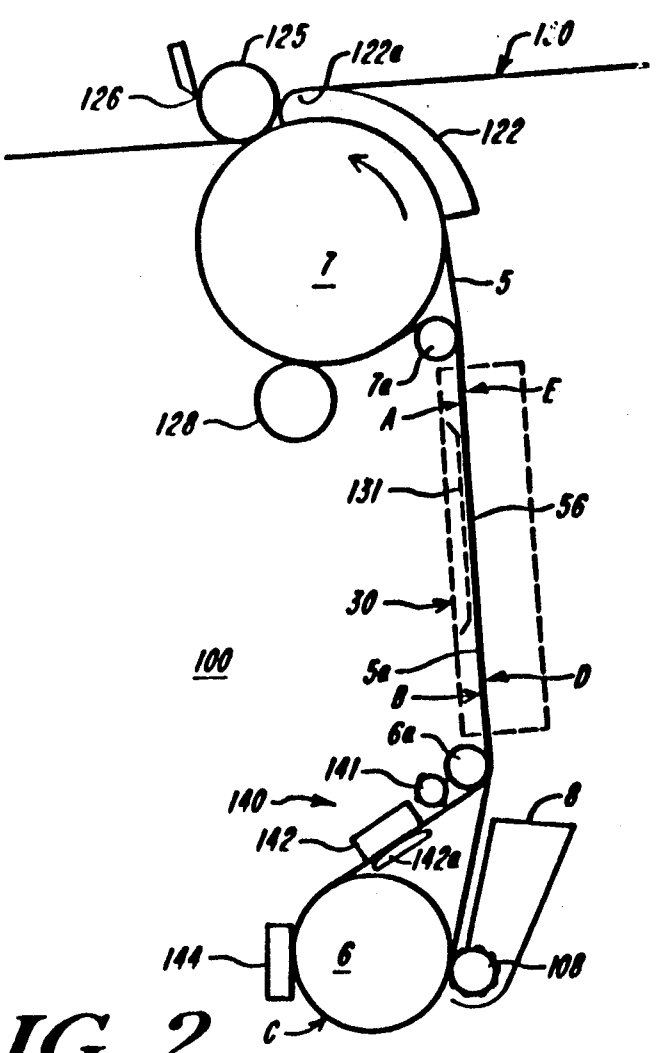
FIG. 2 shows a view corresponding to FIG. 1 with further details of construction in an embodiment as a printing system.

FIG. 2 shows a printing or coating apparatus 100 employing the counterflow heat exchange transport system of FIG. 1. Corresponding elements are numbered identically, and are laid out in the same relative positions for clarity of exposition. The apparatus functions to deliver a heat fusible thermoplastic, e.g., a pigment or toner, to a heated station where it is transferred to a moving web or sheet 150.

In the illustrated apparatus, the belt 5 is a belt having a dielectric layer which is charged to form a latent charge image, and toner particles from a reservoir 8 are applied by a brush or other applicator 108 so that they adhere to the charged portions of the belt. The belt outer surface has a hard skin, so that the toner powder adheres only in the charged regions of the latent image. The adhered toner is transported to the heated station at roller 7 where an array of heaters within the roller as well as heater lamps 122 directed at the belt soften the transported toner. A paper web 150 is fed by a feed mechanism (not shown) and is preferably preheated (e.g., by the same heater 122 at shoulder 122*a*) before it is pressed at a relatively low pressure against the belt 5 by a print roller 125 to receive the softened toner therefrom. This results in a single-step mechanical transfer and fusing of the softened toner image to the paper. This "transfuse" step contrasts with conventional processes, wherein the transferred image is generally fused to the paper at a separate heating station.

A scraper 126 maintains the roller 125 clean, and a cleaner roller 128 having an absorbent or adhesive jacket contacts the belt to pick up any untransferred residual toner from the belt, so that the portion of the belt 5*a* leaving the heated roller 7 is clean. As in FIG. 1, knee rollers 7*a*, 6*a* preferably position the intermediate belt portions 5*a*, 5*b* in heat-exchange contact. A platen 131 (shown in phantom) of non heat conductive material and low thermal mass may urge the counter-moving belt portions into more intimate contact between the knee rollers. Alternatively, an intermediate plate of conductive low friction material, such as cast iron, may be placed between the two moving belt portions to conduct heat from one to the other in a thermal shunt.

After moving through the heat exchange region 30, the cleaned and cooled belt portion 5*a* passes to an electrostatic imaging area 140 where a corona discharger, e.g., a corona rod 141, erases the residual belt surface charge distribution. The belt then passes to one or more controllable print heads 142, 144 which selectively deposit an imagewise charge distribution on the moving belt so that toner next applied by applicator 108 will adhere to the belt with a spatial distribution corresponding to the desired image. In the prototype embodiment, the printhead 144 was an ionographic printhead of the general type shown in U.S. pat. No. 4,160,257 and later patents. printhead 144 may, however, comprise an electrostatic pin array or other latent-image charge applying means.

The two latent image depositing printheads 142, 144 illustrate two different approaches to mounting a printhead in relation to the belt. Printhead 144 is opposed to the drum 6, creating an image deposition geometry similar to that of existing dielectric drum-based systems presently on the market. Printhead 142 is positioned opposite an anvil 142*a* against which the belt is urged. Anvil 142*a* is shaped to provide a desired surface flatness or curvature in order for the belt to faithfully receive the charge pattern formed by printhead 142. This latter construction reveals that the described dielectric belt system is adapted to generate latent charge images by the placement of plural electrostatic or ionographic printheads at arbitrary positions along the belt ahead of the toner applicator 8, 108. In practice a single printhead, e.g., printhead 144, is sufficient for single-tone or single-color printing.

The toner employed in the prototype was a magnetic dry powder toner with a meltable thermoplastic pigment material. Good results were obtained with the common Hitachi HI-TONER HMT201 heat fusing magnetic toner operating with a hot drum maintained at 165° Celsius and a belt speed of 38 cm/sec. This particular toner is compounded with a 10–30 micron particle size distribution. Similar single or multi-component fusible toners, such as a Coates M7094 or Rp1384, Yield comparable results with drum temperatures in the range of 105° to 145° C. at this speed.

It will be observed that the system of FIG. 2 has several advantageous properties. First, after the toner passes heater 122 it is softened and is transferred and fused to the paper in a single step. Thus, unlike conventional systems wherein the transferred toner is carried on the sheet to a separate fusing station, there is negligible airborne toner dust released into the electrostatic image-generating region. Further, unlike a pressure-fixed toner, the heat-softened toner is transferred to the web 150 using a relatively low contact pressure, under approximately 100 psi, so that high pressure skew rollers, which could smear the image, are not necessary. The low pressure resilient rollers can transfer the image to relatively thick, rough, heat-sensitive or electrically conductive substrates, thus providing a new process for forming patterns or images on such materials. Third, the heat-softened toner produces archival quality adhesion to the print. It is also observed that by using a single imaging element consisting of a belt, image registration between different stations is easily achieved. Furthermore, changes of printing speed may be effected without substantial modification of the mechanical transport mechanisms.

A belt suitable for the system 100 has two sets of characteristics. First, the heat capacity and heat-transfer characteristics are preferably such that effective counterflow heat exchange occurs at reasonable belt operating speeds. Second, the belt charging and toner pick-up and release properties are preferably such that a suitable latent charge image is formed, and that the belt effectively picks up and then fully releases the toner in each image cycle.

With regard to the thermal requirements of the belt, applicant has performed simulations and measurements to determine the energy requirements of a belt formed of different materials, such as an aluminized polyimide KAPTON film, an aluminized KAPTON film coated with PTFE, and a stainless steel belt. These simulations and experiments supported the conclusion that for thin belts (under approximately a millimeter thick) at belt speeds of 0.5–1.0 m/s, the thermal conductivity of the belt was less critical than the heat capacity of the belt material in determining the power exchanged in counterflow exchange path 30 and the power lost to the cool drum 6. Thus, stainless steel required several times as much power input at each belt speed, and coated polyimide performed less efficiently than the uncoated film.

Figure 3:
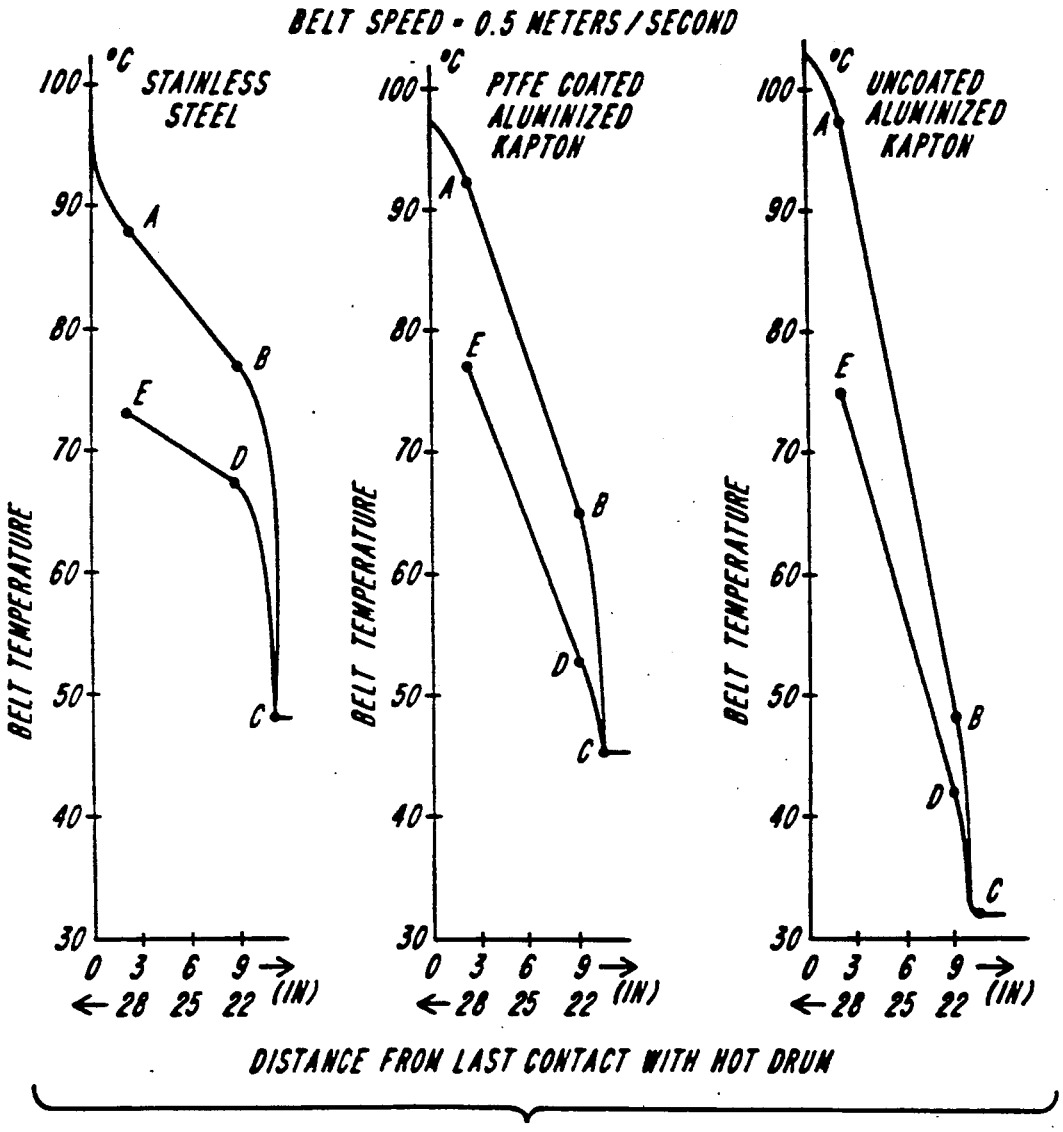
FIG. 3 shows thermal characteristics of different heat exchange belts.

FIG. 3 shows representative temperature readings taken on belts of the above materials having a length of approximately one meter and run on a test jig at a speed of approximately 0.5 m/sec. The temperature was measured at points A, B, C, D, E corresponding to those shown in FIG. 2, after an initial warm up period. As shown, the total heat transfer between portions of the belt, which is proportional to the difference $T_E$–$T_D$, and the power lost to the cold drum, which is proportional to the temperature difference TB−TC, are each significantly better with the uncoated Kapton belt. The stainless steel belt, because of its greater heat capacity, did not effectively reduce the excess hot side belt temperature. Similarly, the PTFE-coated belt was less effective at this belt speed due to its increased mass.

The belt speed of approximately 0.5 m/sec. is representative of a desirable speed for a printer to achieve a printing speed of one sheet or more per second. The ability of the countermoving belt portions to exchange heat and each reach a substantially uniform temperature through their thickness dimension depends on their thickness, specific heat, length of contact, belt speed and frictional forces. Applicant has found that a belt thickness of approximately 0.10 mm, and preferably in the range of 0.02–0.20 mm, provides effective transfer for the full thickness of the belt at a range of belt speeds of 0.1 to 2.5 m/sec. suitable for printing. A number of commercially available film or sheet materials, such as stainless steel, beryllium-copper, various forms of Kapton sheet, and other materials are all suitable belt materials, possessing the necessary tensile strength, heat mass and conductivity. At higher speeds optimal for printing, materials with a lesser heat mass are superior. Higher thermal conductivity does not markedly affect the heat transfer over the range of small belt thicknesses contemplated.

In addition to these physical parameters, applicant has found that when the facing layers of the belt are formed of a dielectric material, so that they accumulate charge, then a measurable improvement in heat transfer characteristics occurs due to the opposing belt portions being drawn into more effective thermal contact by electrostatic attraction between the oppositely moving portions of the charged belt. An assymmetry in the locations of roller placement or the like is sufficient to cause the necessary difference in triboelectric charging of the two counter-moving belt portions which establishes such attraction. Preferably the belt is somewhat conductive to prevent excessive static charge build up that increases the mechanical drag of the belt.

The second aspect of belt construction which is important to the operation of the thermoplastic printing apparatus 100 relates to the toner pick-up and release characteristics of the belt. These attributes will be discussed with reference to the above-described printhead structure, which, in accordance with general principles known in the literature, operates by depositing a latent image charge on a dielectric member such that a charge up to several hundred volts is deposited at a point of the member for attracting toner particles to the dielectric member.

For such operation, applicant has employed a belt with a capacitance of approximately 125 to 225 pf/cm$^2$, and considers a preferred range for other common charging and toning systems to be 50 to 500 pf/cm$^2$. For certain systems, such as one with a stylus-type charging head, a belt capacitance of approximately 1000 pf/cm$^2$ may be desired, and for other systems operation with a belt capacitance as low as 10 pf/cm$^2$ may be feasible. The construction of a preferred belt having a capacitance of 125–225 pf/cm$^2$ falling within such capacitance range is discussed in greater detail below, following consideration of toner release characteristics.

Applicant has found that transfer members which conform adequately to a paper surface for full transfer of an image present a technical problem for the development of a latent image with powdered toner. The outer skin of the belt is preferably of a hard material, in order to assure that powdered toner is attracted to and maintained at only those regions bearing a latent image charge. Applicant has found, however, that with a hard material microscopic voids appear in the transferred image, and that these voids correspond to irregular surface features in the paper or print medium. Thus, paper fibers, grit and surface features having a dimension of approximately 0.01 mm characteristic of the surface roughness of a paper surface may prevent the full transfer of toner when a heated toner-bearing hard belt is pressed against a sheet.

These two problems of accomplishing both a high quality toning and complete image transfer are overcome by providing on the belt an elastomeric layer of a sufficient softness to conform to the rough paper surface, and by covering the elastomeric layer with a hard surface coating. The hard coating is sufficiently thin to still allow the belt surface to conform to the rough paper surface, but is hard enough to assure that the belt surface does not conform to substantially smaller features, and does not entrain paper dust or toner particles. The hard coating is sufficiently hard to prevent surface conformance to features of 100 Angstroms or less, and thus prevents the Van der Wals molecular attractive forces from acting on a toner particle over an area of intimate contact sufficient to adhere it to the belt. On the other hand, when the toner is heat-softened or melted, and mechanical pressure is applied to transfer the toner to a paper or other material, applicant has found that the surface material having a low surface free energy enhances toner transfer since the low surface free energy material is abhesive. These several characteristics of the belt assure that the surface is not "tacky" and does not develop sufficient molecular attractive forces to retain toner in the absence of the applied latent image charge, or in the presence of the mechanical adhesion of the heated toner to paper.

By way of example, suitable elastomeric and hard coating properties may be obtained with an elastomeric layer approximately 0.05 mm thick formed on a Kapton belt with a silicone rubber of a 30 Shore A durometer, overcoated with a 0.005 mm thick layer of a polymer having a hardness of approximately 35–45 Shore D.

A suitable hard coating material is the silicone resin conformal coating material sold by Dow Corning as its R-4-3117 conformal coating. This is a methoxy-functional silicone resin in which a high degree of cross-linking during curing adds methoxy groups to elevate the overall molecular weight of the polymerized coating. Suitable materials for the belt substrate include 0.05 mm thick films of Ultem, Kapton or other relatively strong and inextensible web materials such as silicone-filled woven Nomex or Kevlar cloth, capable of operating at temperatures of up to approximately 200° C. Suitable conductive material is included in or on the substrate layer to control charging and provide a ground plane. Suitable elastomeric intermediate layer materials include silicone rubbers, fluoropolymers such as Viton, and other heat-resistant materials having a hardness of about 20–50 Shore A.

Figure 4A:
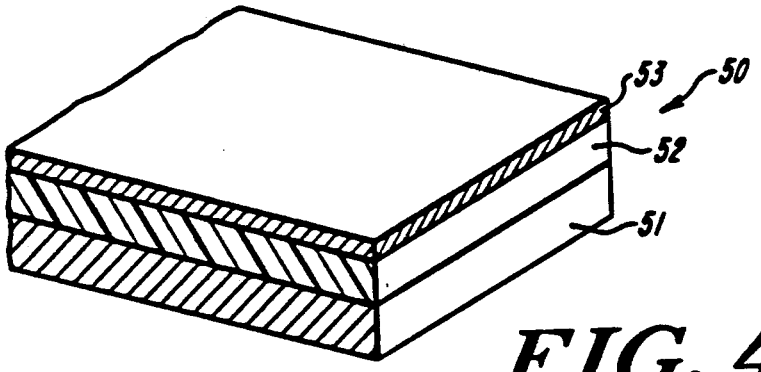
FIGS. 4A–4C show preferred layer structures for transport members suitable for the embodiment of FIG. 2.
Figure 4B:
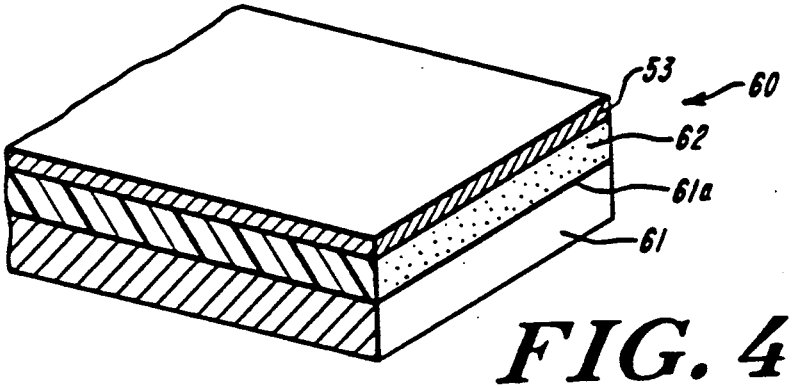
Figure 4C:
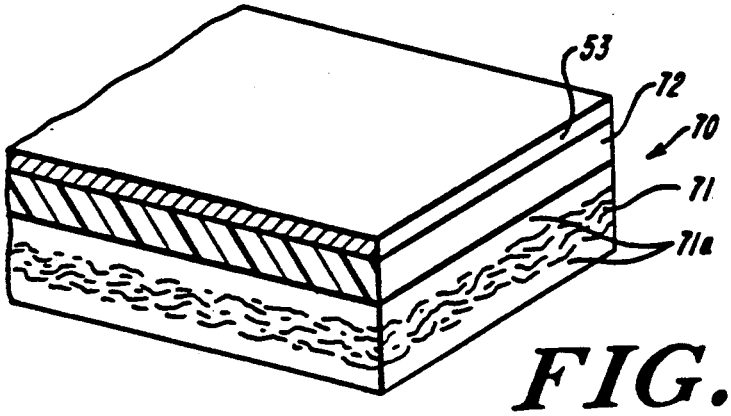

FIGS. 4A, 4B, 4C illustrate three different belt constructions illustrating a range of features.

In FIG. 4A, a belt 50 includes an electrically conductive support 51 of 0.05 mm thick aluminized Kapton, having a 0.04 mm thick layer 52 of a silicone rubber overcoated with a hard skin coat 53 which is 0.005 mm thick. Layer 52 has a 35 Shore A durometer, whereas surface coat 53 has a 45 Shore D durometer. Because the various polymers have dielectric constants of between two and three, the multilayer construction is preferable modified by including a high dielectric filler material in at least one layer. The use of filler in this manner increases the hardness, and accordingly a thicker elastomer layer or a softer elastomer is used in such a construction to retain the desired surface conformability.

FIG. 4B shows such a filled belt construction, 60. In this embodiment, the substrate is formed of a 0.05 mm thick thermally conductive film 61 having a metallized face 61*a*, such as the MT film of Dupont. Elastomeric layer 62 is formed of a 0.05 mm coating of silicone rubber compounded by Castall, Inc. of Weymouth, Mass., loaded with a sufficient amount of barium titanate in a prepared formulation to achieve a dielectric constant of 13, and having a net hardness of about 40–45 Shore A. The hard skin outer coat 53 is identical to that of FIG. 4A. Other additives may be mixed in or substituted in order to adjust the belt capacitance, thermal conductivity, hardness or electrical properties. For example, a metal powder filler achieves high capacitance without excessive hardening. For various photoelectric techniques, a photoconductive filler may be used as described further in relation to FIGS. 7A–9, below.

FIG. 4C shows an alternative belt construction 70 wherein a low density woven fabric belt 71 is impregnated with a soft electrically conductive silicone rubber binder 71*a* to form a conductive layer 0.075 mm thick. A suitable rubber may have a 35 Shore A durometer, and electrical conductivity of $10^3$ ohm centimeters. In this case, the substrate is conformable, and the silicone rubber layer 72 may thus be quite thin since no additional softness is needed. For example, layer 72 may be formed with an elastomer of 30 Shore A hardness and a thickness of under 0.05° mm. Layer 72 is coated with a hard skin 53 as in the other examples. The layers 72, 53 are thus sufficiently thin to achieve a high capacitance without a filler.

In the last two above cases, the use of a conductive substrate allows the belt to be grounded by using grounded conductive rollers 6, 7 in the apparatus of FIG. 2.

When using the Dow corning R-4-3117 silicone resin coating material described above as the non-tacky surface coat, applicant has found that outer layers having a thickness of 0.0025–0.005 mm appear thin enough to allow the belt to conform to surface roughness features of 0.01 mm while being sufficiently hard to prevent toner entrainment. Surface layers thicker than 0.0075–0.01 mm appear too stiff to permit complete image transfer to a paper surface. In applying the hard surface coat, applicant employed a Mayer wire-wound rod as the applicator. For forming the intermediate elastomer layer, the silicone rubber was coated by a knife and roller assembly to create a smooth coating of uniform thickness.

Various modifications of the surface coating constructions indicated above are possible to achieve the desired surface properties. For example, to achieve a hard coat over the soft silicone rubber, one may treat the silicone rubber surface by nitrogen ion bombardment at ion energies of 50–100 KeV and a current of about 0.01 microamps/cm$^2$, with a dose of $10^{13}$ ions/cm$^2$. This provides a slippery hard surface which does not entrain toner powder. Another technique is to treat the elastomer coating by exposure to a plasma. Both ion-bombardment and plasma-reaction techniques are believed to promote cross linking of the surface material. Particular materials may be employed to achieve a desired degree of cross-linked polymerization. For example, a surface coat of a vinyl-dimethyl silicone rubber may be polymerized by electron beam radiation to provide the hard skin of appropriate thickness and hardness. The polymerization of the skin may also be controlled by ultraviolet, catalytic, corona or chemical polymerization techniques.

In any of these fabrication techniques, the substrate provides dimensional stability, while the substrate and subsurface layers together are selected to have sufficient softness to conform to a print member, such as metal sheet, paper or acetate, having a characteristic surface roughness, when urged by a pressure roller at a relatively low pressure of fifty to one hundred and fifty PSI. The elastic deformation of the belt coating must be commensurate with the intended surface roughness at this pressure. The hard surface coat is then formed to be sufficiently hard and thick to prevent entrainment of toner, while not being so hard or thick as to interfere with dimensional conformance of the surface. By using a surface coat of low surface free energy, softened or melted toner does not adhere to the belt, and the toner transfers fully and completely to the print member when pressed. A surface free energy of 20 dynes/cm or less is desirable.

Figure 5:
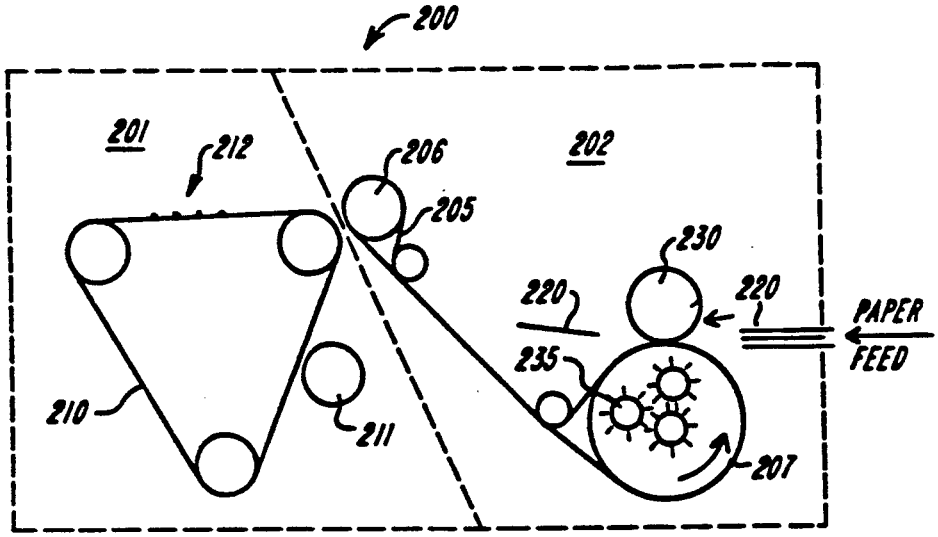
FIG. 5 shows an alternative system including features of the invention.

FIG. 5 shows an alternative embodiment of a printer 200 according to the invention, employing a transfer belt 205 with an elastomeric conforming layer and a hard skin. In this embodiment, a first section of the apparatus includes a latent image forming and toning section 201, and a second section 202 includes a developed image transfer and fusing belt 205. The section 201 is illustrated as including a belt 210 carrying a developed toner image 212. Alternatively, belt 210 may be replaced by a suitable image-carrying member such as a dielectric drum, dielectric plate or a photoconductive member. Section 201 may thus employ entirely conventional photocopying, laser printing or image-forming technology to form a toned image.

The second section 202 includes a transfer belt 205 which may, for example, have a belt construction similar to that illustrated in FIGURE 4A, but may have a non-conductive substrate. Toner is transferred from the belt or drum 210 to the belt 205 by electrostatic charge transfer.

The transfer between members 210 and 205 may be effected either by corona charging the dielectric plastic belt 205, or by electrically biasing the roller 206 behind the belt at the toner transfer point. This transfers the toned image 212 from the original member 210 on which it was formed to the ultimate heat-transfer belt 205. The efficiency of toner transfer using this electrostatic method can be about 90 percent. Consistent electrostatic transfer between sections 201 and 202 takes place due to the lack of surface roughness and lack of variations in electrical conductivity of members 205, 210 of the type which are typically experienced in electrostatic image transfer to paper, and caused by humidity fluctuations. Portion 201 also includes an adhesive or similar cleaner roller 211 which contacts the dielectric imaging member 210 to remove the residual untransferred toner. As in the embodiment of FIGURE 2, the belt 205 moves between its toner pickup point at roller 206 to a fusing station at roller 207 where the fused toner is transferred to a paper sheet or web 220 by pressure roller 230. Preferably, radiant heaters 235 within roller 207 provide the required level of heat input.

The hard skin overcoat of belt 205 decreases the likelihood of paper dust pickup onto this belt surface, and any dust which is present is expected to have little or no impact on the toner image transfer quality. This system is expected to enjoy a long belt life due to the hard skin coating, and thus to constitute an improvement over toner transfer systems employing softer or adhesive-like belts.

Other configurations of the transport assembly of this invention are adapted to achieve photoconductive imaging, hybrid photoconductive/ ionographic or electrostatic imaging, or magnetographic imaging. For these embodiments, a photoconductive or other filler material is added to the belt to affect its electrical imaging characteristics.

Figure 7A:
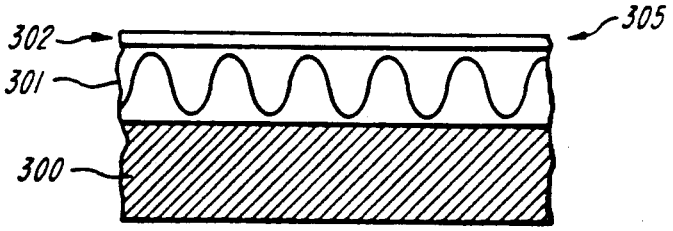
FIG. 7A, 7B show photoconductive embodiments of transport members.
Figure 7B:
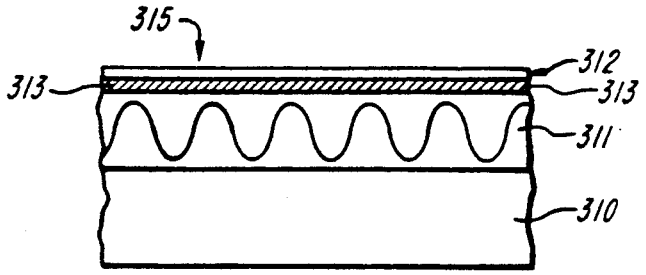

FIGS. 7A, 7B illustrate construction of two such photoconductive belts, 305, 315. Belt 305 shown in FIG. 7A employs an electrically conductive film 300 as its structural base formed of a strong, temperature resistant material such as metal or metallized polyimide. A resilient layer 301 followed by a hard, low surface energy elastic release top layer 302 are provided on the imaging side of the belt. Layer 302 has the mechanical properties of layer 52, and each of layers 301, 302 is filled with a photoconductive material. Example of such materials are salts such as cadmium sulfide or zinc oxide or many of the complex organic or organometallic materials developed for photocopy machines. Many suitable photoconductors exist, and the choice of photoconductor will generally depend on the maximum intended temperature level to be employed for the transfer/fusing operation.

The belt construction 315 of FIG. 7B achieves the electrical and mechanical properties for printing differently. In this embodiment, a hard, low surface energy elastic release layer 312 is deposited over a conductive layer 313 which operates as a ground plane. Layer 313 may be quite thin, well under one micrometer, so that its stiffness is negligible. Layer 312, like layer 302, has mechanical and release characteristics comparable to layer 52 of FIGS. 4A–4C, and like layer 302 is filled with photoconductive material. In this case, all charging or discharging occurs with respect to the two topmost layers 312, 313. The underlying strata 311, 310 provide a spongy conforming level of compressibility, and a strong, temperature resistant support, respectively. Layer 311 may be a simple dielectric, that is, an unfilled and non-conductive polymer, or a polymer filled only with a dielectric-enhancing powder. Layer 310 may be, but need not necessarily be, electrically conductive. Thus, each layer continues to perform functions similar to those described above.

As noted above, a wide variety of photoconductive filler materials may be used. Moreover, because the imaging process involves heating the belt to transfer toner, special attention to temperature characteristics is required when selecting a filler material. For example, an amorphous photoconductive material might crystallize above a certain temperature and become conductive, destroying the latent image, so such material should be avoided when toner fusion above a certain temperature is intended. In general, the upper operating temperature is selected to be roughly the fusing temperature of an intended toner. Thus the range of suitable photoconductive fillers for the imaging belt may be broadened and longevity of the belt enhanced, by employing a low-fusing point toner.

A printing apparatus employing a photoconductive thermal release belt may be incorporated into diverse imaging or printing systems. For example, a latent image may be written on the belt by first charging the belt uniformly and then either optically projecting an image onto the charged surface, or actuating a pattern of light emitting diodes (LEDs) to selectively discharge portions thereof.

Figure 8:
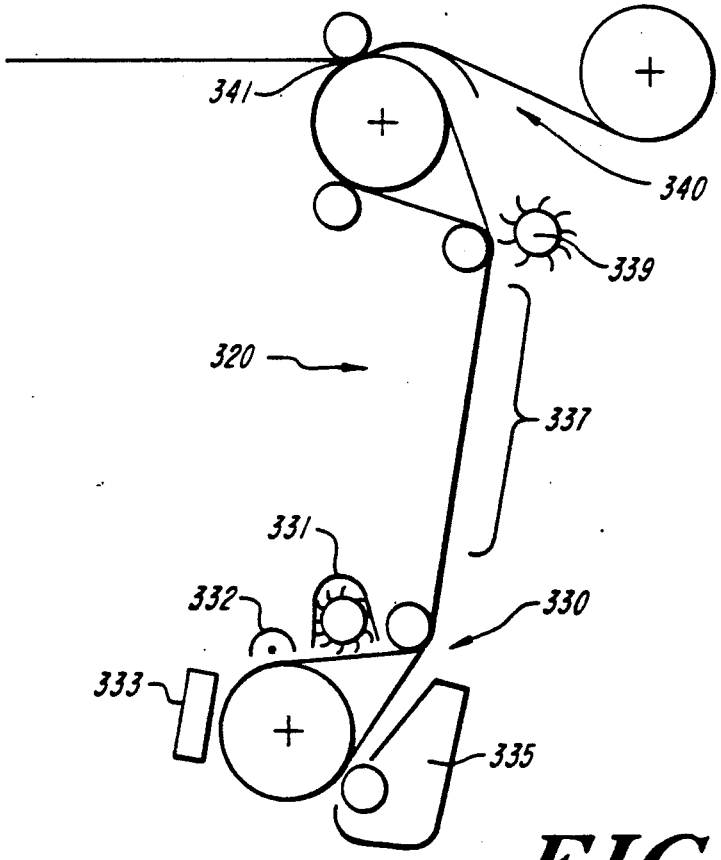
FIG. 8 shows an electrophotographic imaging system according to the invention.

FIG. 8 illustrates one such system 320. In this system, a single imaging belt 325 moves between an image forming zone 330 and a heated image transfer zone 340 as described above. A lamp 331 floods the belt with illumination to discharge the belt before the start of an imaging cycle, and a corona device 332 then precharges the belt to a uniform level. The charged belt next moves past a light imaging device 333 which may include an objective imaging lens for photocopying, or an image-writing light source, such as a laser scanner of an array of discrete LEDs. The selective application of light energy selectively alters the conductivity of the charged belt, so a patterned discharge forms a latent charge image. The latent image is then toned by a toner applicator 335.

The image carrying belt next moves through the heat exchange region 337, undergoing a rise in temperature. It then passes under a second lamp assembly 339 which discharges the latent image to prevent electrostatic forces from hindering the transfer process, and, as before, transfers the softened toner to a recording member at transfer nip 341 before returning for another imaging cycle.

Figure 9:
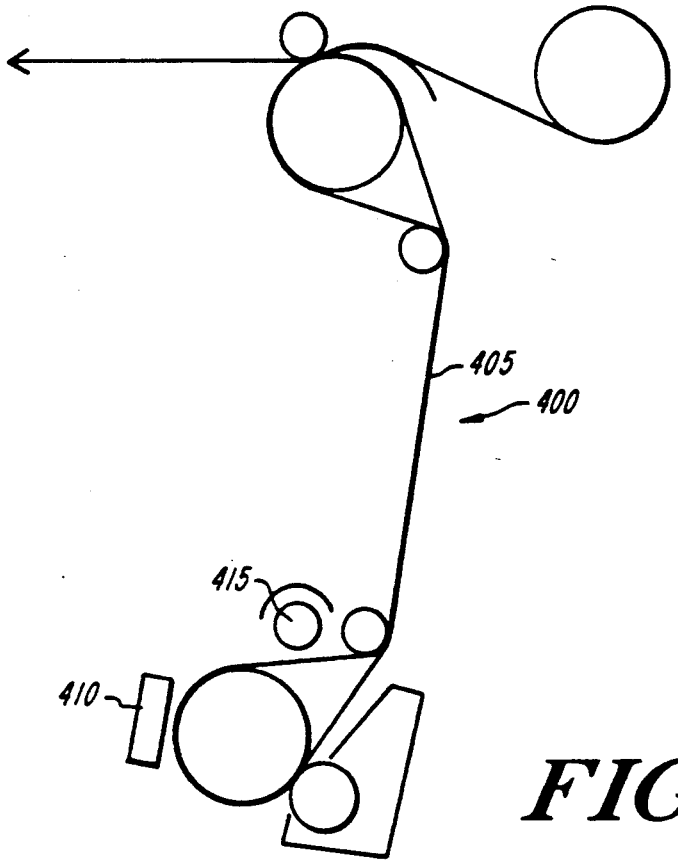
FIG. 9 shows a hybrid electrostatic imaging system according to the invention.

FIG. 9 shows another system 400 employing applicant's thermal transfer imaging belt. In this embodiment, belt 405 receives its latent charge image by a charge deposition process from an electrostatic or "ionographic" printhead or an electron emitter, pin array or other such assembly 410, and the image is toned, heated and transferred as in the earlier described embodiment of such systems. However, following transfer of the toned image, the photoconductive belt moves past a lamp 415 that discharges any remaining charge on the belt. Thus, the belt is erased by illumination. For this embodiment, a sufficiently strong dielectric filler is used to operate with printhead 410, while a photoconductive filler permits erasure by light energy. The use of a light-erasable ionographic imaging belt in this manner eliminates the usual corona rod neutralizer, an unstable or unreliable element, and thus eliminates ozone emission from the system design. It is also possible to provide illumination, for example, by a scanner or LED array as above, in a position between the electrographic printhead 410 and the toner applicator to selectively add or erase blocks or image elements.

The imaging member of the present invention is also adapted to novel systems for magnetographic imaging, wherein a latent image is formed by magnetic means. Examples of magnetographic systems are the Varypress system of Honeywell Bull marketed through Cynthia peripherals Corp. of Sunnyvale, Calif., and the systems of Ferix Corp. of Fremont, Calif. Such systems record a latent image onto a magnetic film on the surface of a metal print drum using an electromagnetic recording head or recording head array, and tone the image with a monocomponent magnetic toner.

Figure 10A:
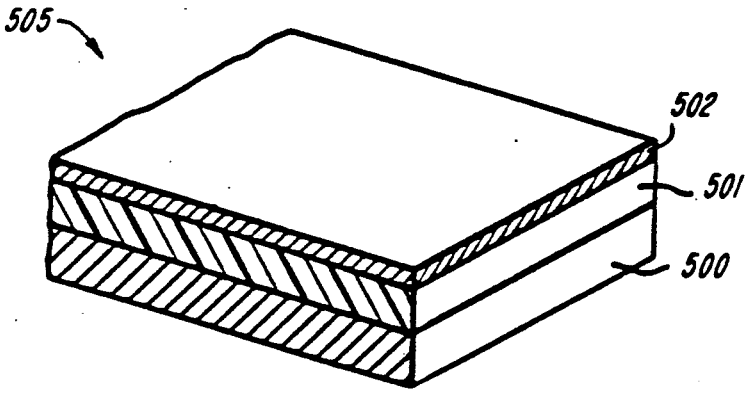
FIGS. 10A, 10B show a magnetic imaging belt and a system employing that belt, respectively, in accordance with the invention.

FIG. 10A shows a belt 505 adapted for magnetic printing in accordance with the present invention. As before, a strong supporting web 500 carries an elastomeric conformance layer 501 and a hard surface release layer 502, which may be formed with dimensions and materials like those of the similar figures described above. In this embodiment, however, layer 501 contains a magnetizable filler medium suitable for recording, such as chromium dioxide, iron oxide or other suitable oxide, a sulfide or other magnetic material. Layer 502 is preferably conductive, either by virtue of a conductive filler or by addition of a metal thin film which may be deposited by sputtering, vapor deposition or electroplating from solution. The purpose of the metal is to prevent the belt from developing static surface charge, which could interfere with the weak magnetic forces responsible for image toning and transfer.

It will be understood that the magnetic layer may be also extended outwardly into the hard skin 502 by addition of filler material to layer 502. The precise details of construction depending to some extent on the desired magnetic field properties and required resolution, among other factors. Layer 502 may contain other materials, such as necessary recording surface polishes, waxes or lubricants, as known in the art, and may itself be polished, buffed or otherwise prepared for mechanical contact or close proximity with a recording head.

Figure 10B:
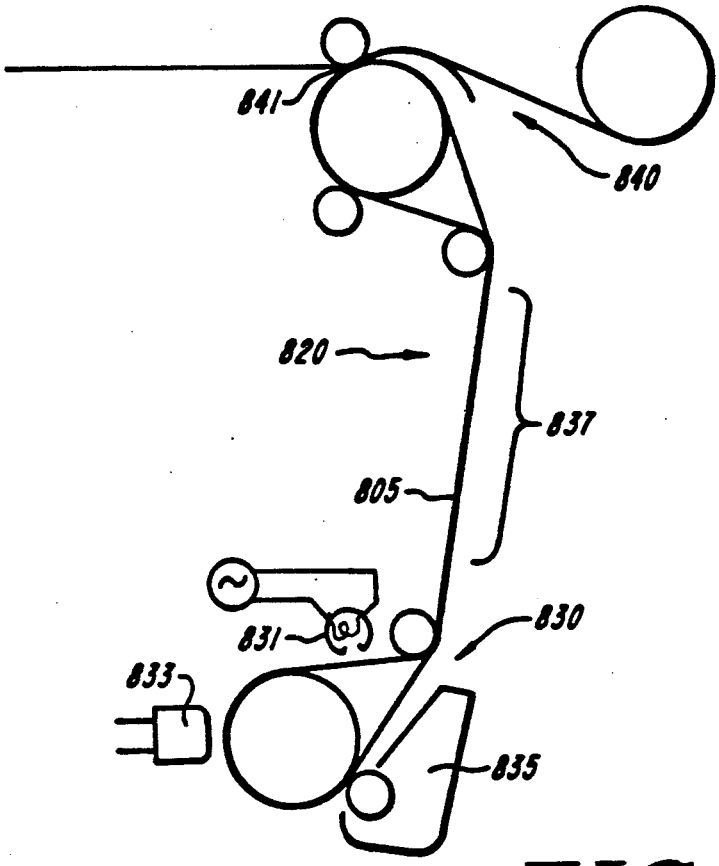

FIG. 10B illustrates a basic printing system 820 employing a magnetically filled belt 805 such as belt 505. In printing system 820 a magnetic-surfaced belt 805 moves between an image-forming station 830 and an image-transfer station 840 at which heated toner is transferred to a recording at nip 841. In passing through an intermediate region 837 heat is transferred from the previously-heated portion of the belt to the just-toned portion of the belt passing out of the image-forming station 830.

The image forming station 830 includes an erase head 831 which applies a magnetic erase field to prepare the surface for a new recording, followed by a recording head 833 which forms a magnetic latent image on the belt. Advantageously, recording head 833 may be mounted to contact the back surface of belt 805, i.e., the surface of supporting web 500. This construction avoids abrasion of the active imaging surface 502 of the belt, and reduces contamination of the recording head. The belt then passes by a toner applicator 835 having a suitable mechanism for applying a monocomponent magnetic toner to the belt without impairing the magnetic image thereon. The toned image then travels to station 840, reaching fusing temperature, and is transferred.

As with the photoconductive embodiments, some consideration must be given to the effect of the high fusing temperature on the image-forming magnetic filler material. Generally, the level of fusing temperatures contemplated for the heat exchange belt will not impair magnetic properties. However, some magnetic materials have a quite low Curie temperature, and will affect the fundamental belt properties. This may be used to advantage. For example, chromium dioxide loses its magnetism at 120° C., so that this filler, when used with a toner fused above that temperature, will have its latent image erased at the time its toned image is transferred. This property may be exploited to improve the efficiency of the toned image transfer, or to operate a system wherein no erase head 831 is needed. On the other hand, by using a magnetic medium that is stable above the intended fusing temperature, the latent image will persist after the toner has been transferred, and the printer may be operated to print multiple copies after a single recording operation. In that case the erase head is actuated only after plural passes of the belt have printed several copies of the recorded image.

Figure 6:
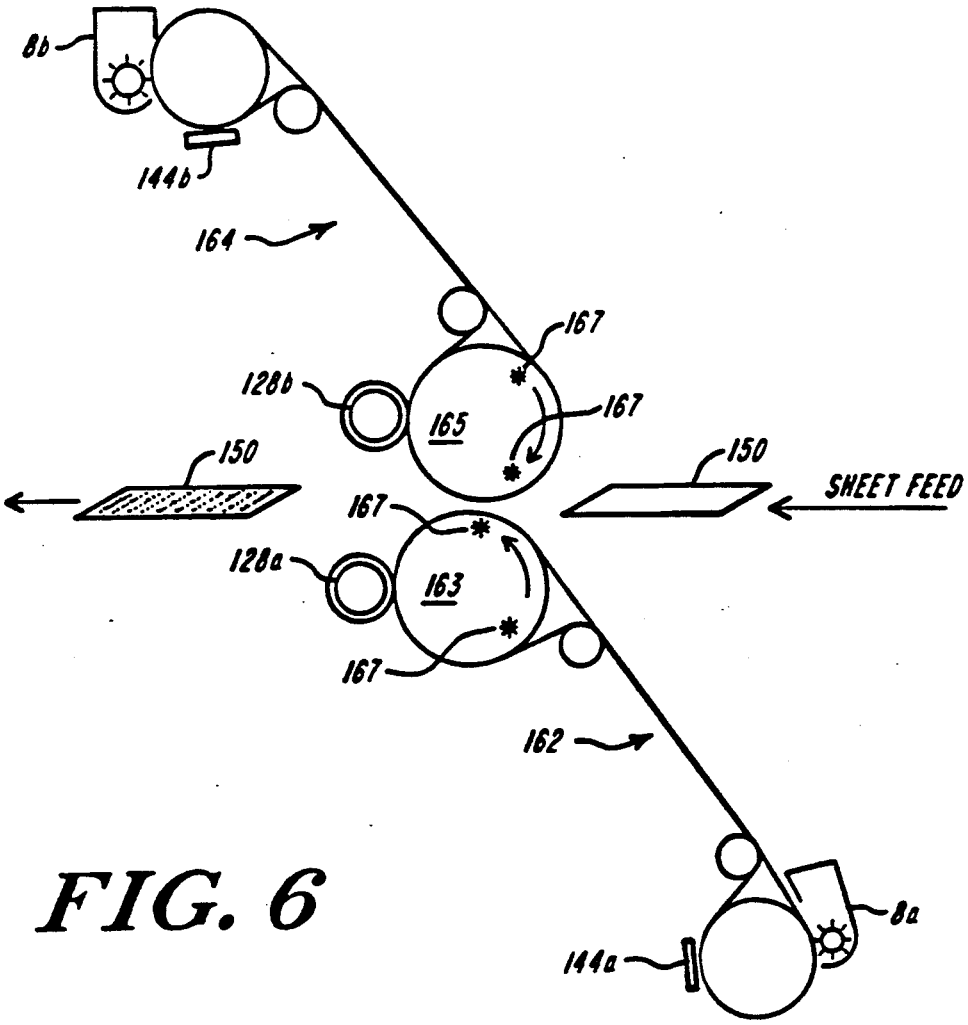
FIG. 6 shows a duplex system according to the invention.

FIG. 6 shows another system 160 according to the invention, which is applicable to any of the particular types of imaging systems described above. In this embodiment, first and second substantially complete belt imaging systems 162, 164 are arranged such that each belt carries a toned image to one of the opposed rollers 163, 165, respectively, which each correspond to the roller 7 of FIG. 2. At rollers 163, 165, the two images are simultaneously transferred to opposing sides of a sheet 150. For clarity of illustration, the toner-softening heaters are illustrated by quartz lamps 167 within the roller drums.

In this embodiment, rather than an arrangement of a drive roller 7 and a pressure roller 125 as in FIG. 2, each of the rollers 163, 165 is a belt drive roller and both have identical surface coating and elastic pressure properties, effective to produce a pressure of about 100-150 psi on a sheet of the desired thickness passing between the rollers. This assures that the transfer of toned image to each side of the paper is uniform. The opposed-belt arrangement of FIG. 6 also greatly simplifies the structure required for image alignment between the two sides of the duplex system, as compared to prior art duplex systems with multiple or serially-driven image transfer members. In fact, where the latent image is formed by an electrically driven charge deposition device 144 as described above, or an LED array, lateral and longitudinal shifts of the deposited image on one belt may be accomplished entirely electronically by appropriate timing shifts introduced in the drive signals applied to the charge deposition device 144. Such timing adjustments may be performed automatically by a belt position detection device which monitors a series of registration marks placed by head 144 outside of the latent image bearing region of the belt.

This completes a description of representative embodiments of the several aspects of the present invention, which has been presented with different specific examples by way of exposition. It will be understood that the invention is not limited to the illustrated examples, but rather includes within its scope numerous modifications, adaptations, variations and improvements of the illustrated examples, as well as applications to systems other than those described.

The principles of the invention being thus disclosed, specific applications will occur to those skilled in the art, and are included within the scope of the invention, as set forth in the following claims.

What is claimed is:

1. An improved printing system of the type wherein a support member moves between first and second stations within the system to transfer a toner image, wherein the improvement resides in that said support member includes a surface for receiving a latent image and said toner, and wherein said surface includes a subsurface layer of an elastomeric softness effective to conform to an image-receiving print medium having a characteristic surface roughness, and a non-tacky surface layer of low surface free energy which coats said first subsurface layer such that the toner, when melted releases therefrom, and a filler material in the support member, said filler material being selected from among photoconductive and magnetic materials.

2. The improved system of claim 1, wherein said surface layer has a hardness effective to prevent entrainment of toner particles, and is sufficiently thin to permit the surface to conform to a pulp-based image-receiving print medium for effectively transferring toner from the support member to print an image.

3. The improved system of claim 2, wherein said surface is smooth and toner normally does not attach to it in the absence of a latent image which attracts toner to adhere.

4. The improved system of claim 3, wherein said support member includes a layer formed of an elastomer material which is loaded with a finely divided material to achieve a sufficient capacitance for holding the latent image.

5. The improved system of claim 3, wherein said support member is semiconductive.

6. The improved system of claim 5, wherein said support member is an endless belt.

7. The improved system of claim 6, wherein the subsurface layer and the surface layer together have a capacitance in the range of 50–250 pf/cm$^2$.

8. The improved system of claim 3, wherein said surface is magnetic.

9. The improved system of claim 3, wherein at least the surface of said support member is photoconductive.

10. A transport member for transferring powdered material, such member comprising a substantially inextensible support member defining a closed circuit path for unidirectional transport of powder between first and second locations, a first coating on the support member, said first coating having an elastomeric composition effective to conform to the surface of a print medium having a characteristic surface roughness, a skin of release material defining an outer surface of said first coating, photoconductive material included in at least one of the skin of release material and the first coating, and a conductive ground plane.

11. A transport member according to claim 10, wherein said release material has a hardness greater than said elastomeric first coating.

12. A transport member according to claim 11, wherein said first coating includes a dielectric filler material.

13. A system for the transport of a toned image between heated and unheated stations in an image forming apparatus, such system comprising a sheet or laminar transport member having a back surface and a front surface, said transport member including a photoconductive or magnetic material for forming a latent image on said front surface, said transport member being formed in a closed loop, first and second motive assemblies for moving said closed loop to transport the toned image between said unheated station and said heated station, and means forming a contact thermal shunt between different portions of said back surface to reduce the transport of thermal energy as the belt moves between said stations.

14. A system according to claim 13, wherein the transport member contains a magnetic filler material, and further comprising a magnetic write head for forming a magnetic latent image on the transport member.

15. A system according to claim 14, wherein the magnetic filler material has a Curie temperature lower than the temperature of the heated station.

16. A system for forming print images on two sides of a sheet member, such system comprising a first photoconductive-belt arranged in a closed loop extending from a first region wherein the first belt receives a first toned image, through a second region wherein the first belt travels over a first resilient roller to urge the first toned image against a sheet member for transferring the first toned image to the sheet member, a second photoconductive belt arranged in a closed loop extending from a third region wherein the second belt receives a second toned image, through a fourth region wherein the second belt travels over a second resilient roller to urge the second toned image against a sheet member for transferring the second toned image to the sheet member, said first and second resilient rollers each having substantially identical resilient characteristics, and being aligned and opposed with each other such that a sheet member passed between the two rollers simultaneously receives said first and second toned images on opposed sides of the sheet member, and said first and second belts each moving between heated and unheated stations at their respective first and second rollers, respectively, each belt contracting a countermoving portion of itself between the stations to transfer heat energy.

17. A system for printing an image on a sheet, such system comprising a housing an endless belt having an imaging surface filled with at least one of a magnetic or a photoconductive material and having a conductive layer, said belt being serially movable between first, second and third locations within the housing, image-forming means for forming a latent image on said imaging surface at said first location, toning means for applying toner at said second location so that it is attracted to and adheres to said belt in accordance with said latent image, and transfer means for contacting said belt with a sheet at said third location to receive the toner therefrom, wherein said toner is a heat-fusible toner and said third location is maintained at a temperature to soften the toner so that the toner is effectively transferred from said belt to said sheet in a softened state in a single step by the application of pressure.

18. A system according to claim 17, wherein the imaging surface is filled with a photoconductive material and the means for forming a latent image includes means for charging the belt and means for directing a pattern of illumination at the charged belt.

19. A system according to claim 18, further including illumination means, located between the toning means and the transfer means, for illuminating the belt to discharge the imaging surface such that electrostatic effects do not hinder transfer of toner to the sheet.

20. A system according to claim 19, wherein the illumination means is located to discharge the belt at the third location such that toner on the belt is softened and dust does not fly off the belt when the imaging surface is discharged.

21. A system according to claim 18, wherein the means for forming a latent image includes means for illuminating the belt to uniformly discharge the imaging surface and means for depositing charge in a imagewise pattern onto the uniformly discharged surface.

22. A system according to claim 17, wherein said belt comprises a dimensionally-stable support substrate, an elastomeric layer on said substrate, and a non-tacky surface layer over said elastomeric layer.

23. A system according to claim 22, wherein said elastomeric layer includes an elastomer and a magnetic filler material.

24. A system according to claim 23, further comprising means for heating the sheet prior to contacting the belt, whereby softened toner is wicked by said paper from the imaging surface to form a print image adhering to the sheet.

25. A system according to claim 24, further comprising means for maintaining oppositely travelling portions of said belt in contact so that they exchange heat in passing between said second and third locations.

26. A system according to claim 17, wherein the imaging surface is filled with a magnetic medium having a Curie temperature below the temperature of the third location, and the latent image is formed by a magnetic recording head, so that the latent image is erased when the belt passes the third location to transfer toner to a sheet.

27. A system according to claim 17, wherein the imaging surface is filled with a magnetic medium having a Curie temperature above the temperature of the third location, and the latent image persists for forming multiple toning and transfer operations to form multiple prints from a single magnetic recording operation.

* * * * *